US010462578B2

(12) United States Patent
Hoskins et al.

(10) Patent No.: US 10,462,578 B2
(45) Date of Patent: Oct. 29, 2019

(54) PIEZOELECTRIC CONTACT MICROPHONE WITH MECHANICAL INTERFACE

(71) Applicant: Intel Corporation, Santa Clara, CA (US)

(72) Inventors: Kevin R. Hoskins, Santa Clara, CA (US); Arun P. Jose, Santa Clara, CA (US); David Harkness, Santa Clara, CA (US); Georgios C. Dogiamis, Chandler, AZ (US); Rajashree Raji Baskaran, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 227 days.

(21) Appl. No.: 15/589,203

(22) Filed: May 8, 2017

(65) Prior Publication Data

US 2018/0324530 A1 Nov. 8, 2018

(51) Int. Cl.

| | |
|---|---|
| ***H04R 25/00*** | (2006.01) |
| ***H04R 17/02*** | (2006.01) |
| *H04R 1/46* | (2006.01) |
| *H04R 1/26* | (2006.01) |

(52) U.S. Cl.

CPC ..... *H04R 17/02* (2013.01); *H04R 1/265* (2013.01); *H04R 1/46* (2013.01); *H04R 2410/07* (2013.01); *H04R 2499/11* (2013.01)

(58) Field of Classification Search

CPC ..... H04R 1/46; H04R 2499/11; H04R 17/02; A61B 7/045; A61B 5/023; A61B 5/022; A61B 5/02208

USPC ..... 381/173

See application file for complete search history.

(56) References Cited

U.S. PATENT DOCUMENTS

| | | | | | |
|---|---|---|---|---|---|
| 4,012,604 | A * | 3/1977 | Speidel | A61B 5/021 | 181/171 |
| 4,520,238 | A * | 5/1985 | Ikeda | H04R 1/46 | 381/151 |
| 4,591,668 | A * | 5/1986 | Iwata | H04R 1/46 | 381/151 |
| 4,607,383 | A * | 8/1986 | Ingalls | H04R 1/14 | 381/113 |
| 2005/0244020 | A1 * | 11/2005 | Nakajima | G10L 15/24 | 381/151 |

(Continued)

*Primary Examiner* — Phylesha Dabney

(74) *Attorney, Agent, or Firm* — Schwegman Lundberg & Woessner, P.A.

(57) ABSTRACT

A piezoelectric contact microphone with a mechanical vibration conduction interface provides an improved mobile electronic device microphone. In an embodiment, the mechanical vibration conduction interface is placed on a bone structure and conducts vibration from the bone structure to the piezoelectric contact microphone. Because of the direct contact, this use of piezoelectric contact microphone reduces or eliminates interferences effects due to wind and other airflow over the microphone. The mechanical vibration conduction interface materials and structure are selected to provide effective transmission of vibration from the bone structure to the piezoelectric element within the piezoelectric contact microphone. This piezoelectric contact microphone enables mobile electronic devices to provide improved voice communication, voice transcription, and voice command recognition in the presence of wind noise and other noise.

20 Claims, 4 Drawing Sheets

(56) References Cited

U.S. PATENT DOCUMENTS

| | | | | |
|---|---|---|---|---|
| 2007/0269060 | A1* | 11/2007 | Chou | H04R 1/46 381/174 |
| 2009/0175478 | A1* | 7/2009 | Nakajima | H04R 1/46 381/361 |
| 2018/0324530 | A1* | 11/2018 | Hoskins | H04R 1/46 |

* cited by examiner

PIEZOELECTRIC CONTACT MICROPHONE WITH MECHANICAL INTERFACE

TECHNICAL FIELD

Embodiments described herein generally relate to audio microphones.

BACKGROUND

Mobile electronic devices use microphones to conduct voice communications and voice commands. In particular, voice commands are increasingly used on mobile electronic devices to dictate text or control device functions. However, the microphones used on mobile devices are subject to substantial interference from surrounding environmental noise. Environmental noise may include noise from traffic, noise from machines operating within in an industrial setting, noise from loud voices in crowded environments (e.g., "cocktail party effect"), wind noise, or other interfering noise. In many environments, microphone performance is most affected by wind noise, such as when used outdoors in windy environments, when used while running, bicycling, skiing, or snowboarding, or when used during any activity that causes air to flow across the microphone port. The movement of air across the microphone port introduces wind noise into the microphone's output signal, where the wind noise can render the desired microphone signal (e.g., voice commands, phone conversation, etc.) unusable. When unusable, the device is likely not to respond to voice commands and phone conversations are difficult. What is needed is an improved wind-resistant mobile electronic device microphone.

DESCRIPTION OF EMBODIMENTS

A technical solution to technical problems facing mobile electronic device microphones includes a piezoelectric contact microphone with a mechanical vibration conduction interface. In an embodiment, the mechanical vibration conduction interface is placed against the skin of a user in a location where the skin covers a bone structure that is located close to the skin surface. A mechanical vibration is conducted from the bone structure through the skin and the mechanical vibration conduction interface to the piezoelectric contact microphone. Because of the direct contact, this piezoelectric contact microphone reduces or eliminates interferences effects due to wind and other airflow over the piezoelectric contact microphone. Especially in high-noise environments, the piezoelectric contact microphone provides significant improvement in signal-to-noise ratios over microphones that include open-air openings over transducer membranes that accept sound waves from any source.

As described below, the mechanical vibration conduction interface materials and structure are selected to provide effective transmission of vibration from the bone structure to the piezoelectric element within the piezoelectric contact microphone. This piezoelectric contact microphone enables mobile electronic devices to provide improved voice communication, voice transcription, and voice command recognition in the presence of wind noise and other noise.

The following description and the drawings sufficiently illustrate specific embodiments to enable those skilled in the art to understand the specific embodiment. Other embodiments may incorporate structural, logical, electrical, process, and other changes. Portions and features of various embodiments may be included in, or substituted for, those of other embodiments. Embodiments set forth in the claims encompass all available equivalents of those claims.

Figure 1:
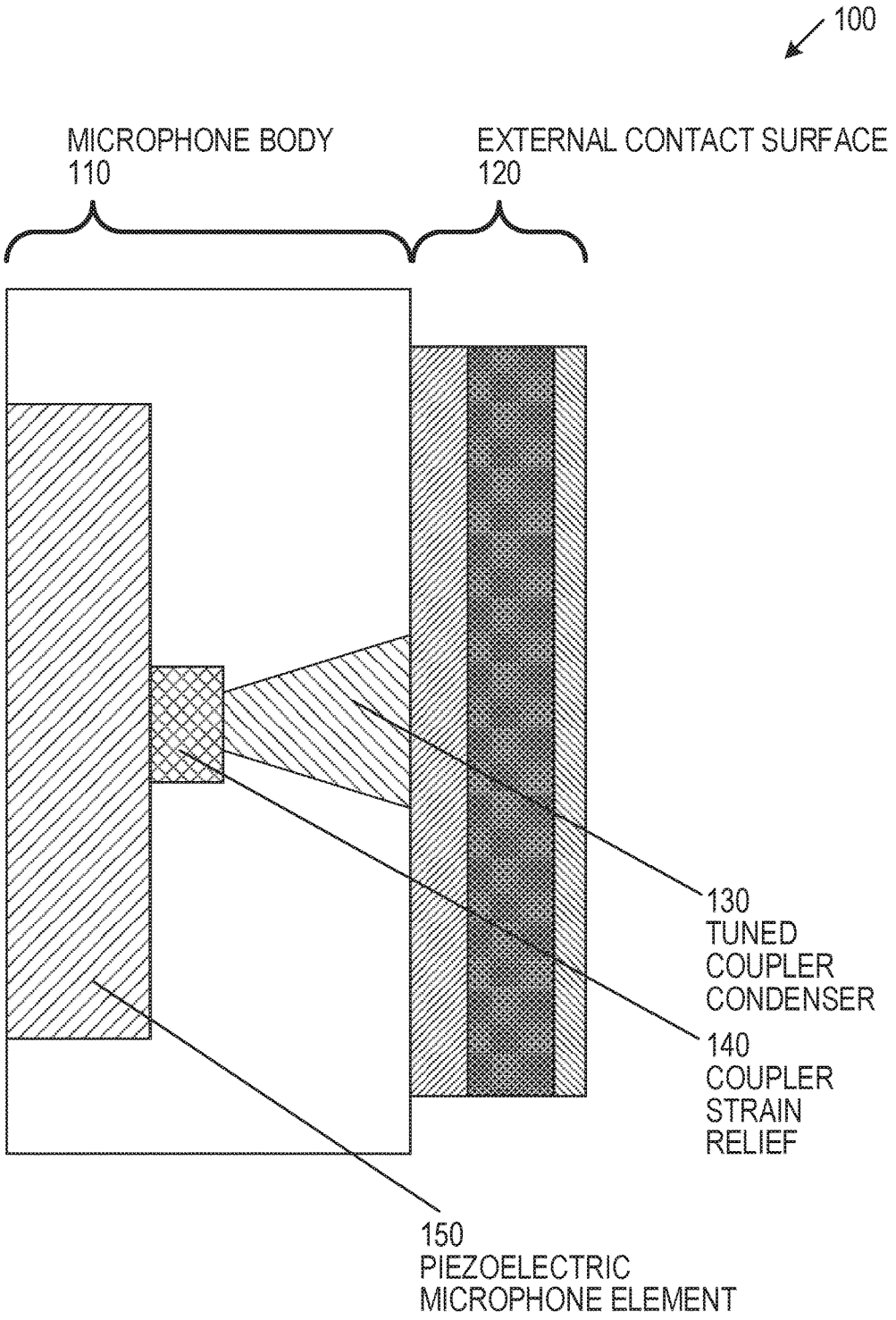
FIG. 1 is a perspective diagram of piezoelectric contact microphone, in accordance with at least one embodiment.

FIG. 1 is a perspective diagram of piezoelectric contact microphone 100, in accordance with at least one embodiment. The piezoelectric contact microphone 100 includes a microphone body 110 and an external contact surface 120. In operation, the external contact surface 120 is placed on a bone structure (e.g., on a user's facial bone) and conducts vibration from the bone structure to the microphone body 110. The external contact surface 120 may include multiple layers, where the layer materials and structures are selected to provide a tuned contact surface. For example, the external contact surface 120 may include one or more vibration-conductive materials to convey a vibration within an audible frequency range from a bone structure to the microphone body 110. The external contact surface 120 may include an outermost biocompatible layer to reduce skin irritation when placed on a bone structure.

The microphone body 110 may include a tuned coupler condenser 130, a coupler strain relief 140, and a piezoelectric microphone element 150. The tuned coupler condenser 130 and coupler strain relief 140 convey vibrations from the bone structure to the piezoelectric microphone element 150. The piezoelectric microphone element 150 includes a crystalline piezoelectric material that receives the vibrations and produces a voltage proportional to the applied to it by the impinging sound waves. The tuned coupler condenser 130 includes a vibration conductive material, and may be tuned to convey a vibration within an audible frequency range received at the interface between the microphone body 110 and the external contact surface 120. For example, the coupler condenser 130 may include a larger surface adjacent to the external contact surface 120 and a smaller surface opposite from the external contact surface 120, such that the force exerted on the larger surface area is increased when focused onto the smaller surface area.

The coupler strain relief 140 forms a mechanical connection to convey vibration between the tuned coupler condenser 130 and the piezoelectric microphone element 150. The piezoelectric microphone element 150 includes a crystalline piezoelectric material, and the coupler strain relief 140 may be designed to convey instantaneous vibration movements while resisting larger movements that may deform the piezoelectric microphone element 150 past a fracturing point. In an embodiment, coupler strain relief 140 may include an initially pliable material that is cured to form a vibration-conductive material. For example, manufacturing the microphone body 110 may include disposing the coupler strain relief 140 as a pliable material on the piezoelectric microphone element 150, disposing the tuned coupler condenser 130 on the coupler strain relief 140, allowing the piezoelectric microphone element 150 to restore itself to an uncompressed state, and curing the pliable coupler strain relief 140 into an unpliable and vibration-conductive material. In various embodiments, the pliable coupler strain relief includes a thermoplastic, a thermoset polymer, or other material that is heated to a pliable state and subsequently cured to form a vibration-conductive solid material.

In another embodiment, the coupler strain relief 140 may include a non-Newtonian fluid that conveys instantaneous vibrations within a desired frequency range while allowing for larger movements below the desired frequency range without damaging the piezoelectric microphone element 150. The non-Newtonian fluid may include a shear thickening material (e.g., dilatant material) whose viscosity increases disproportionately with applied force. For example, the shear thickening material may thicken (e.g., increase viscosity) in response to a vibration within a desired frequency range, thereby conveying the vibration from the tuned coupler condenser 130 to the piezoelectric microphone element 150. When not exposed to the vibration within a desired frequency range, the shear thickening material may maintain a low viscosity to allow for a readjustment of the distance between the tuned coupler condenser 130 and the piezoelectric microphone element 150, such as a compression applied during a readjustment of the piezoelectric contact microphone 100 against a bone structure. One or more walls of the enclosure for the coupler strain relief 140 may be flexible to accommodate movement of the non-Newtonian fluid.

The desired frequency range may include frequencies associated with audible frequencies (e.g., 20 Hz to 20 kHz), however the coupler strain relief 140 and other elements within the piezoelectric contact microphone 100 may convey the vibrations primarily through mechanical (i.e., non-audible) means. The materials used in the coupler strain relief 140 and other elements within the piezoelectric contact microphone 100 may be selected to convey a specific frequency range, or other signal characteristics.

The piezoelectric contact microphone 100 provides advantages over alternative microphone technologies. For example, the capacitive membrane structures found in a microelectromechanical system microphone (MEMS microphone) typically requires a high-voltage bias (e.g., 60 volts) that is modulated by a relative movement between two layers within a capacitive MEMS two-layer diaphragm. The performance of MEMS microphones are therefore affected by anything in contact with or affecting the movement of the MEMS diaphragm. In contrast, the piezoelectric contact microphone 100 structure is based on direct contact with a mechanical coupling structure that transmits vibration from a bone structure directly to the piezoelectric element 150. In another example, the performance of capacitive-based microphones is adversely affected by various environmental contaminants, such as dust, moisture, and other contaminants. In contrast, the direct contact and enclosed structure within the piezoelectric contact microphone 100 are not subject to the failure mechanisms that can render these capacitive-based microphones non-functional. In another example, a moving-coil microphone includes a coil and magnet, which produces a varying current in response to acoustic input. However, the sensitivity of such moving-coil microphones is proportionate to their size, where decreasingly small moving-coil microphones provide an output signal level that is too small to be useful. In contrast, the performance of the piezoelectric contact microphone 100 is minimally affected by a decrease in size, enabling the piezoelectric contact microphone 100 to be used in products that are small, thin, lightweight, or require more than one microphone.

As a further advantage, piezoelectric contact microphone 100 provides desired significant frequency response and distortion limitations with minimal software processing. For example, when alternate microphone technologies are reduced in size for use in a mobile electronic device, the frequency response is decreased, non-linearities are present, and hence distortion is increased. Software processing may reduce some of the effects of the compromised frequency response or distortion, however the software processing introduces additional requirements such as a processor, a power supply element, a passive or active digital signal processing filter, or other requirements. In contrast, the piezoelectric element 150, coupler strain relief 140, tuned coupler condenser 130, and external contact surface 120 are tuned to provide a substantially flat frequency response and substantially low distortion. This improved frequency response and reduced distortion provides improved audio fidelity and intelligibility before any software processing, thereby reducing or eliminating the need for software processing. Further, the coupler strain relief 140, tuned coupler condenser 130, and external contact surface 120 include materials specifically selected to provide desired transfer functions and frequency bandwidth transmission to maximize acoustic performance.

Figure 2:
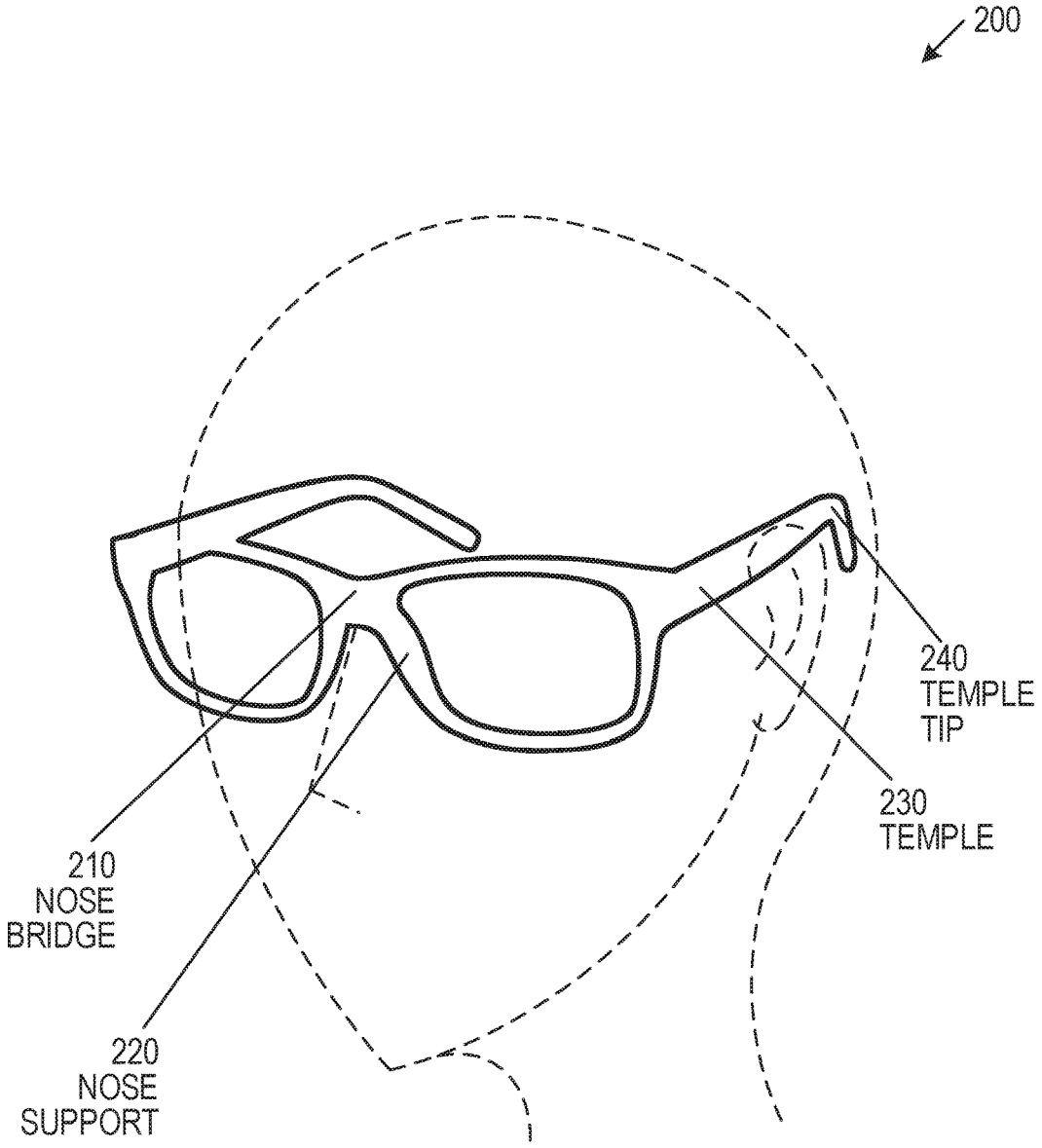
FIG. 2 is a perspective diagram of piezoelectric contact microphone eyeglasses, in accordance with at least one embodiment.

FIG. 2 is a perspective diagram of piezoelectric contact microphone eyeglasses 200, in accordance with at least one embodiment. The small size of the piezoelectric contact microphone 100 enables placement in head-worn devices, such as within piezoelectric contact microphone eyeglasses 200. The piezoelectric contact microphone 100 may be implemented in the nose bridge 210 or within the nose support 220, where it may be applied against a nasal bone or frontal bone (i.e., forehead). The piezoelectric contact microphone 100 may also implemented in the temple 230 or within the temple tip 240, where it may be applied against a temporal bone, a zygomatic bone, a mastoid process, or another skull bone. In an embodiment, multiple piezoelectric contact microphones 100 may be used within a device to provide multiple channels, such as a center channel within the nose bridge 210 and a left and right channel within each of the temple tips 240. These spatially disparate inputs may be used for various audible signal processing features, such as noise cancellation, target isolation (i.e., directional audible beamforming), characterization of head-related transfer functions (HRTF), or other signal processing features. In an embodiment, multiple piezoelectric contact microphones 100 may be used within a device to provide signal processing compensation for acoustic and mechanical properties of the human skull, such as and how each human skull geometry affects the acoustic signals received at each of the spatially disparate piezoelectric contact microphones 100.

The structure and materials used within the piezoelectric contact microphone 100 may be selected based on the target bone structure. For example, a piezoelectric contact microphone 100 placed in the nose support 220 may provide cushioning while conducting vibrations, whereas a microphone 100 placed in a temple 230 may provide reduced cushioning and increased vibration conduction. In various embodiments, materials may include synthetic rubber, elastomers, natural rubber, and other materials necessary to create the mechanical interface between the user and the piezoelectric contact microphone 100. The structure and material choices (e.g., densities and composition) of the piezoelectric contact microphone 100 can be used to linearize response, reduce total harmonic distortion (THD), extend frequency response, or provide other desire signal processing features. The structure and material choices may be selected to provide a signal that requires little or no digital signal processing to produce a voice signal. In an embodiment, the structure and material choices are selected to provide a voice signal with specific performance based on vocal recognition, vocal clarity, or other vocal features.

While piezoelectric contact microphone eyeglasses 200 provide an example application of the piezoelectric contact microphone 100, the piezoelectric contact microphone 100 may be used in other head-worn applications. For example, the piezoelectric contact microphone 100 may be implemented in hats, sweatbands, protective helmets, hearing assistance devices, Bluetooth headsets, audio headphones, or other head-worn applications. The piezoelectric contact microphone 100 may be used in other mobile electronic devices applied against a bone structure. For example, the piezoelectric contact microphone 100 may be implemented in a cellular phone configured to be held against a skull bone in front of the ear, a watch worn against a wrist, a ring worn against a finger, or other device configured to be applied against a bone structure.

Figure 3:
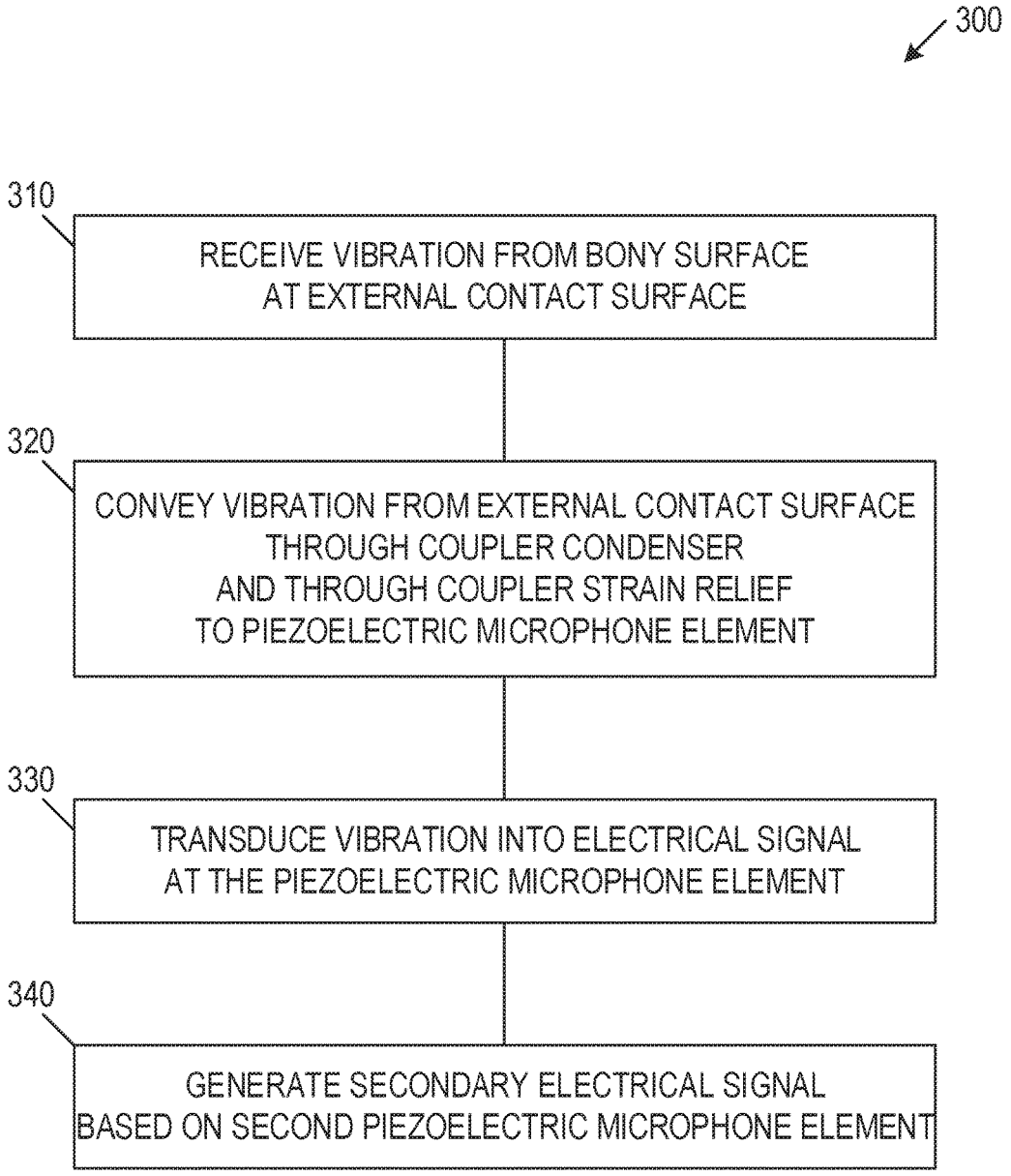
FIG. 3 is a block diagram of a piezoelectric contact microphone method, in accordance with at least one embodiment.

FIG. 3 is a block diagram of a piezoelectric contact microphone method 300, in accordance with at least one embodiment. The piezoelectric contact microphone method 300 includes receiving 310 a vibration from a bony surface at an external contact surface. The external contact surface may include a vibration-conductive contact material. The external contact surface may include a biocompatible layer to reduce skin irritation when placed on the bony surface.

The piezoelectric contact microphone method 300 includes conveying 320 the vibration from the external contact surface through a coupler condenser and a coupler strain relief to a piezoelectric microphone element. The coupler strain relief conducts vibrations from the coupler condenser to the piezoelectric microphone element while resisting a larger piezoelectric deformation. The coupler strain relief may include an initially pliable material cured during manufacturing to form the vibration-conductive condenser material. The coupler strain relief may include a shear thickening material to conduct an instantaneous vibration signal and to allow for a low-frequency readjustment of the coupler strain relief. The coupler strain relief may include at least one flexible surface to accommodate movement of the shear thickening material. The coupler condenser may include a vibration-conductive condenser material. The coupler condenser may include a larger surface proximate to the external contact surface and a smaller surface proximate to the coupler strain relief, the combination of the larger surface and the smaller surface to increase a force per area unit on the coupler strain relief.

The piezoelectric contact microphone method 300 includes transducing 340 the vibration into an electrical signal at the piezoelectric microphone element. A plurality of materials within the piezoelectric microphone element, coupler strain relief, coupler condenser, and external contact surface are selected to produce a voice signal that does not require digital signal processing. The plurality of materials may be selected to provide at least one of a linearized frequency response, a reduced total harmonic distortion (THD), and an extended frequency response. The plurality of materials may be selected to provide at least one of an improved vocal recognition and an improved vocal clarity.

The piezoelectric microphone element, coupler strain relief, and coupler condenser may be disposed within a microphone body housing. The microphone body housing is disposed within a head-worn accessory. For example, the head-worn accessory may include a pair of eyeglasses, where the microphone body housing is disposed within an eyeglasses bridge, within an eyeglasses nose support, within an eyeglasses temple, or within an eyeglasses temple tip. The head-worn accessory may include at least one of a hat, a sweatband, a protective helmet, a hearing assistance device, a Bluetooth headset, and an audio headphone. In an embodiment, the microphone body housing is disposed within a mobile electronic device, such as a cellular phone, a wristwatch, and a finger ring.

The piezoelectric contact microphone method 300 includes generating 340 a secondary electrical signal. Generating 340 the secondary electrical signal may be based on a secondary piezoelectric microphone element, a secondary coupler strain relief, and a secondary coupler condenser disposed in a second location, the secondary electrical signal to provide a spatially disparate signal processing feature. The spatially disparate signal processing feature may include at least one of noise cancellation, directional audible beamforming, and characterization of a head-related transfer function (HRTF).

Figure 4:
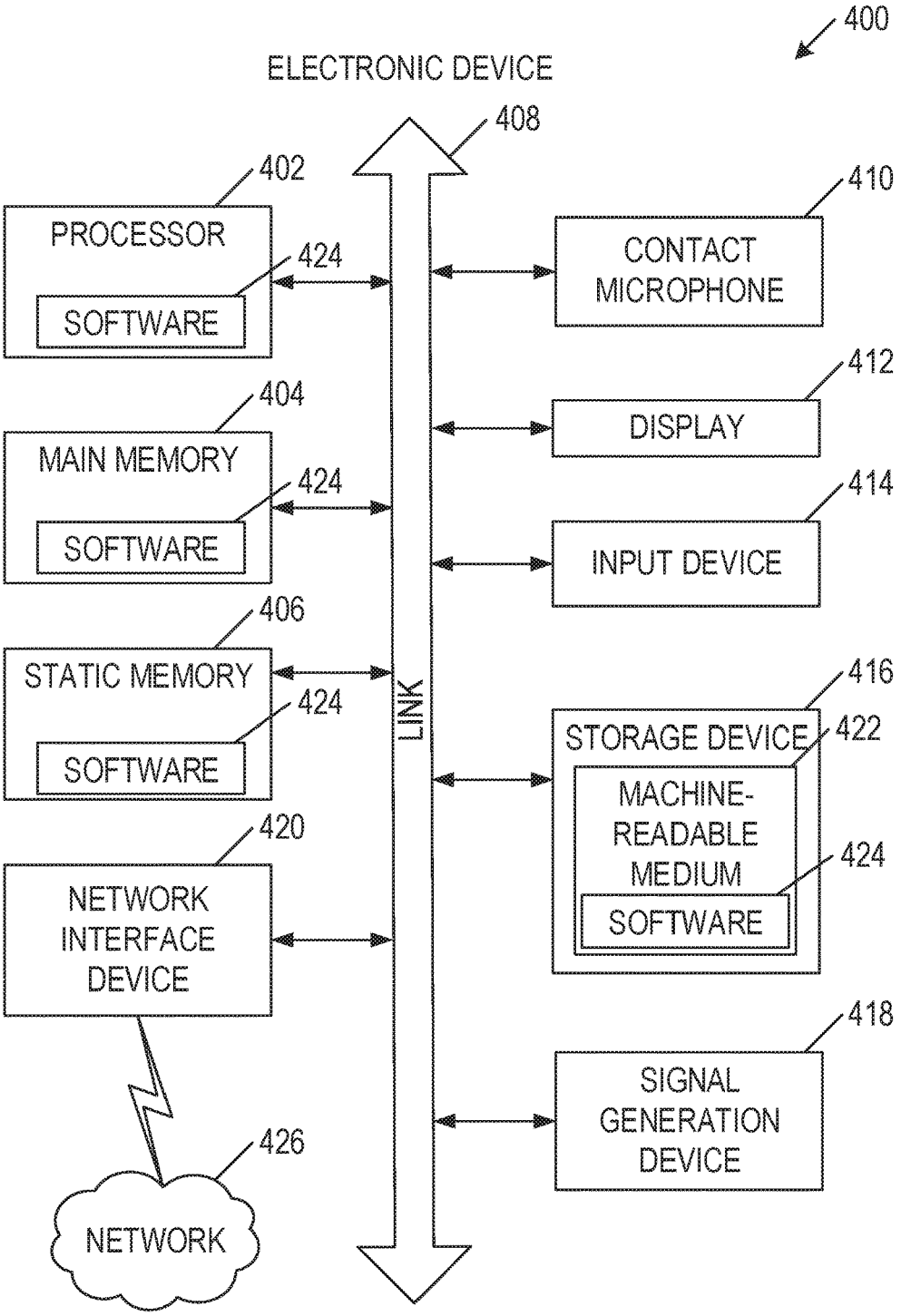
FIG. 4 is a block diagram illustrating a contact microphone system in the example form of an electronic device, according to an example embodiment.

FIG. 4 is a block diagram illustrating a contact microphone system in the example form of an electronic device 400, within which a set or sequence of instructions may be executed to cause the machine to perform any one of the methodologies discussed herein, according to an example embodiment. Electronic device 400 may also represent the devices shown in FIGS. 1-2. In alternative embodiments, the electronic device 400 operates as a standalone device or may be connected (e.g., networked) to other machines. In a networked deployment, the electronic device 400 may operate in the capacity of either a server or a client machine in server-client network environments, or it may act as a peer machine in peer-to-peer (or distributed) network environments. The electronic device 400 may be an integrated circuit (IC), a portable electronic device, a personal computer (PC), a tablet PC, a hybrid tablet, a personal digital assistant (PDA), a mobile telephone, or any electronic device 400 capable of executing instructions (sequential or otherwise) that specify actions to be taken by that machine to detect a user input. Further, while only a single electronic device 400 is illustrated, the terms "machine" or "electronic device" shall also be taken to include any collection of machines or devices that individually or jointly execute a set (or multiple sets) of instructions to perform any one or more of the methodologies discussed herein. Similarly, the term "processor-based system" shall be taken to include any set of one or more machines that are controlled by or operated by a processor (e.g., a computer) to execute instructions, individually or jointly, to perform any one or more of the methodologies discussed herein.

Example electronic device 400 includes at least one processor 402 (e.g., a central processing unit (CPU), a graphics processing unit (GPU) or both, processor cores, compute nodes, etc.), a main memory 404 and a static memory 406, which communicate with each other via a link 408 (e.g., bus).

The electronic device 400 includes a contact microphone 410, where the contact microphone 410 may include audio or vibration transducers as described above. The electronic device 400 may further include a display unit 412, where the display unit 412 may include a single component that provides a user-readable display and a protective layer, or another display type. The electronic device 400 may further include an input device 414, such as a pushbutton, a keyboard, an NFC card reader, or a user interface (UI) navigation device (e.g., a touch-sensitive input). The electronic device 400 may additionally include a storage device 416, such as a solid-state drive (SSD) unit. The electronic device 400 may additionally include a signal generation device 418 to provide audible or visual feedback, such as a speaker to provide an audible feedback or one or more LEDs to provide a visual feedback. The electronic device 400 may additionally include a network interface device 420, and one or more additional sensors (not shown), such as a global positioning system (GPS) sensor, compass, accelerometer, or other sensor.

The storage device 416 includes a machine-readable medium 422 on which is stored one or more sets of data structures and instructions 424 (e.g., software) embodying or utilized by any one or more of the methodologies or functions described herein. The instructions 424 may also reside, completely or at least partially, within the main memory 404, static memory 406, and/or within the processor 402 during execution thereof by the electronic device 400. The main memory 404, static memory 406, and the processor 402 may also constitute machine-readable media.

While the machine-readable medium 422 is illustrated in an example embodiment to be a single medium, the term "machine-readable medium" may include a single medium or multiple media (e.g., a centralized or distributed database, and/or associated caches and servers) that store the one or more instructions 424. The term "machine-readable medium" shall also be taken to include any tangible medium that is capable of storing, encoding or carrying instructions for execution by the machine and that cause the machine to perform any one or more of the methodologies of the present disclosure or that is capable of storing, encoding or carrying data structures utilized by or associated with such instructions. The term "machine-readable medium" shall accordingly be taken to include, but not be limited to, solid-state memories, and optical and magnetic media. Specific examples of machine-readable media include non-volatile memory, including but not limited to, by way of example, semiconductor memory devices (e.g., electrically programmable read-only memory (EPROM), electrically erasable programmable read-only memory (EEPROM)) and flash memory devices; magnetic disks such as internal hard disks and removable disks; magneto-optical disks; and CD-ROM and DVD-ROM disks.

The instructions 424 may further be transmitted or received over a communications network 426 using a transmission medium via the network interface device 420 utilizing any one of a number of well-known transfer protocols (e.g., HTTP). Examples of communication networks include a local area network (LAN), a wide area network (WAN), the Internet, mobile telephone networks, and wireless data networks (e.g., Wi-Fi, NFC, Bluetooth, Bluetooth LE, 3G, 5G LTE/LTE-A, WiMAX networks, etc.). The term "transmission medium" shall be taken to include any intangible medium that is capable of storing, encoding, or carrying instructions for execution by the machine, and includes digital or analog communications signals or other intangible medium to facilitate communication of such software.

To better illustrate the method and apparatuses disclosed herein, a non-limiting list of embodiments is provided here.

Example 1 is a piezoelectric contact microphone system comprising: a piezoelectric microphone element; a coupler strain relief disposed on the piezoelectric microphone element; a coupler condenser disposed on the coupler strain relief; and an external contact surface disposed between the coupler condenser and a bony surface to conduct vibrations from the bony surface through the coupler condenser and coupler strain relief to the piezoelectric microphone element.

In Example 2, the subject matter of Example 1 optionally includes the coupler strain relief configured to conduct vibrations from the coupler condenser to the piezoelectric microphone element while resisting a larger piezoelectric deformation.

In Example 3, the subject matter of Example 2 optionally includes the coupler strain relief including an initially pliable material cured during manufacturing to form the vibration-conductive condenser material.

In Example 4, the subject matter of any one or more of Examples 2-3 optionally include the coupler strain relief including a shear thickening material to conduct an instantaneous vibration signal and to allow for a low-frequency readjustment.

In Example 5, the subject matter of any one or more of Examples 3-4 optionally include the coupler strain relief including at least one flexible surface to accommodate movement of the shear thickening material.

In Example 6, the subject matter of any one or more of Examples 1-5 optionally include the coupler condenser including a vibration-conductive condenser material.

In Example 7, the subject matter of any one or more of Examples 1-6 optionally include the coupler condenser including a larger surface proximate to the external contact surface and a smaller surface proximate to the coupler strain relief, the combination of the larger surface and the smaller surface to increase a force per area unit on the coupler strain relief.

In Example 8, the subject matter of any one or more of Examples 1-7 optionally include the external contact surface including a vibration-conductive contact material.

In Example 9, the subject matter of any one or more of Examples 1-8 optionally include the external contact surface including a biocompatible layer to reduce skin irritation when placed on the bony surface.

In Example 10, the subject matter of any one or more of Examples 1-9 optionally include wherein a plurality of materials within the piezoelectric microphone element, coupler strain relief, coupler condenser, and external contact surface are selected to produce a voice signal that minimizes digital signal processing.

In Example 11, the subject matter of any one or more of Examples 1-10 optionally include wherein a plurality of materials within the piezoelectric microphone element, coupler strain relief, coupler condenser, and external contact surface are selected to produce a voice signal that does not require digital signal processing.

In Example 12, the subject matter of any one or more of Examples 10-11 optionally include wherein the plurality of materials are selected to provide at least one of a linearized frequency response, a reduced total harmonic distortion (THD), and an extended frequency response.

In Example 13, the subject matter of any one or more of Examples 10-12 optionally include wherein the plurality of materials are selected to provide at least one of an improved vocal recognition and an improved vocal clarity.

In Example 14, the subject matter of any one or more of Examples 1-13 optionally include wherein the piezoelectric microphone element, coupler strain relief, and coupler condenser are disposed within a microphone body housing.

In Example 15, the subject matter of Example 14 optionally includes wherein the microphone body housing is disposed within a head-worn accessory.

In Example 16, the subject matter of Example 15 optionally includes wherein the head-worn accessory includes a pair of eyeglasses.

In Example 17, the subject matter of any one or more of Examples 15-16 optionally include wherein the microphone body housing is disposed within an eyeglasses bridge, within an eyeglasses nose support, within an eyeglasses temple, or within an eyeglasses temple tip.

In Example 18, the subject matter of any one or more of Examples 15-17 optionally include wherein the head-worn accessory includes at least one of a hat, a sweatband, a protective helmet, a hearing assistance device, a Bluetooth headset, and an audio headphone.

In Example 19, the subject matter of any one or more of Examples 14-18 optionally include wherein the microphone body housing is disposed within a mobile electronic device.

In Example 20, the subject matter of Example 19 optionally includes wherein the mobile electronic device includes at least one of a cellular phone, a wristwatch, and a finger ring.

In Example 21, the subject matter of any one or more of Examples 1-20 optionally include a secondary piezoelectric microphone element, a secondary coupler strain relief, and a secondary coupler condenser disposed in a second location to provide a spatially disparate signal processing feature.

In Example 22, the subject matter of Example 21 optionally includes wherein the spatially disparate signal processing feature includes at least one of noise cancellation, directional audible beamforming, and characterization of a head-related transfer function (HRTF).

Example 23 is a method for implementing a piezoelectric contact microphone comprising: receiving a vibration from a bony surface at an external contact surface; conveying the vibration from the external contact surface through a coupler condenser and a coupler strain relief to a piezoelectric microphone element; and transducing the vibration into an electrical signal at the piezoelectric microphone element.

In Example 24, the subject matter of Example 23 optionally includes wherein the coupler strain relief is configured to conduct vibrations from the coupler condenser to the piezoelectric microphone element while resisting a larger piezoelectric deformation.

In Example 25, the subject matter of Example 24 optionally includes wherein the coupler strain relief includes an initially pliable material cured during manufacturing to form the vibration-conductive condenser material.

In Example 26, the subject matter of any one or more of Examples 24-25 optionally include wherein the coupler strain relief includes a shear thickening material to conduct an instantaneous vibration signal and to allow for a low-frequency readjustment.

In Example 27, the subject matter of any one or more of Examples 25-26 optionally include wherein the coupler strain relief includes at least one flexible surface to accommodate movement of the shear thickening material.

In Example 28, the subject matter of any one or more of Examples 23-27 optionally include wherein the coupler condenser includes a vibration-conductive condenser material.

In Example 29, the subject matter of any one or more of Examples 23-28 optionally include wherein the coupler condenser includes a larger surface proximate to the external contact surface and a smaller surface proximate to the coupler strain relief, the combination of the larger surface and the smaller surface to increase a force per area unit on the coupler strain relief.

In Example 30, the subject matter of any one or more of Examples 23-29 optionally include wherein the external contact surface includes a vibration-conductive contact material.

In Example 31, the subject matter of any one or more of Examples 23-30 optionally include wherein the external contact surface includes a biocompatible layer to reduce skin irritation when placed on the bony surface.

In Example 32, the subject matter of any one or more of Examples 23-31 optionally include wherein a plurality of materials within the piezoelectric microphone element, coupler strain relief, coupler condenser, and external contact surface are selected to produce a voice signal that minimizes digital signal processing.

In Example 33, the subject matter of any one or more of Examples 23-32 optionally include wherein a plurality of materials within the piezoelectric microphone element, coupler strain relief, coupler condenser, and external contact surface are selected to produce a voice signal that does not require digital signal processing.

In Example 34, the subject matter of any one or more of Examples 32-33 optionally include wherein the plurality of materials are selected to provide at least one of a linearized frequency response, a reduced total harmonic distortion (THD), and an extended frequency response.

In Example 35, the subject matter of any one or more of Examples 32-34 optionally include wherein the plurality of materials are selected to provide at least one of an improved vocal recognition and an improved vocal clarity.

In Example 36, the subject matter of any one or more of Examples 23-35 optionally include wherein the piezoelectric microphone element, coupler strain relief, and coupler condenser are disposed within a microphone body housing.

In Example 37, the subject matter of Example 36 optionally includes wherein the microphone body housing is disposed within a head-worn accessory.

In Example 38, the subject matter of Example 37 optionally includes wherein the head-worn accessory includes a pair of eyeglasses.

In Example 39, the subject matter of any one or more of Examples 37-38 optionally include wherein the microphone body housing is disposed within an eyeglasses bridge, within an eyeglasses nose support, within an eyeglasses temple, or within an eyeglasses temple tip.

In Example 40, the subject matter of any one or more of Examples 37-39 optionally include wherein the head-worn accessory includes at least one of a hat, a sweatband, a protective helmet, a hearing assistance device, a Bluetooth headset, and an audio headphone.

In Example 41, the subject matter of any one or more of Examples 36-40 optionally include wherein the microphone body housing is disposed within a mobile electronic device.

In Example 42, the subject matter of Example 41 optionally includes wherein the mobile electronic device includes at least one of a cellular phone, a wristwatch, and a finger ring.

In Example 43, the subject matter of any one or more of Examples 23-42 optionally include generating a secondary electrical signal based on a secondary piezoelectric microphone element, a secondary coupler strain relief, and a secondary coupler condenser disposed in a second location, the secondary electrical signal to provide a spatially disparate signal processing feature.

In Example 44, the subject matter of Example 43 optionally includes wherein the spatially disparate signal processing feature includes at least one of noise cancellation, directional audible beamforming, and characterization of a head-related transfer function (HRTF).

Example 45 is at least one machine-readable medium including instructions, which when executed by a computing system, cause the computing system to perform any of the methods of Examples 23-44.

Example 46 is an apparatus comprising means for performing any of the methods of Examples 23-44.

Example 47 is at least one machine-readable storage medium, comprising a plurality of instructions that, responsive to being executed with processor circuitry of a computer-controlled device, cause the computer-controlled device to: receive a vibration from a bony surface at an external contact surface; convey the vibration from the external contact surface through a coupler condenser and a coupler strain relief to a piezoelectric microphone element, and transduce the vibration into an electrical signal at the piezoelectric microphone element.

In Example 48, the subject matter of Example 47 optionally includes wherein the coupler strain relief is configured to conduct vibrations from the coupler condenser to the piezoelectric microphone element while resisting a larger piezoelectric deformation.

In Example 49, the subject matter of Example 48 optionally includes wherein the coupler strain relief includes an initially pliable material cured during manufacturing to form the vibration-conductive condenser material.

In Example 50, the subject matter of any one or more of Examples 48-49 optionally include wherein the coupler strain relief includes a shear thickening material to conduct an instantaneous vibration signal and to allow for a low-frequency readjustment.

In Example 51, the subject matter of any one or more of Examples 49-50 optionally include wherein the coupler strain relief includes at least one flexible surface to accommodate movement of the shear thickening material.

In Example 52, the subject matter of any one or more of Examples 47-51 optionally include wherein the coupler condenser includes a vibration-conductive condenser material.

In Example 53, the subject matter of any one or more of Examples 47-52 optionally include wherein the coupler condenser includes a larger surface proximate to the external contact surface and a smaller surface proximate to the coupler strain relief, the combination of the larger surface and the smaller surface to increase a force per area unit on the coupler strain relief.

In Example 54, the subject matter of any one or more of Examples 47-53 optionally include wherein the external contact surface includes a vibration-conductive contact material.

In Example 55, the subject matter of any one or more of Examples 47-54 optionally include wherein the external contact surface includes a biocompatible layer to reduce skin irritation when placed on the bony surface.

In Example 56, the subject matter of any one or more of Examples 47-55 optionally include wherein a plurality of materials within the piezoelectric microphone element, coupler strain relief, coupler condenser, and external contact surface are selected to produce a voice signal that minimizes digital signal processing.

In Example 57, the subject matter of any one or more of Examples 47-56 optionally include wherein a plurality of materials within the piezoelectric microphone element, coupler strain relief, coupler condenser, and external contact surface are selected to produce a voice signal that does not require digital signal processing.

In Example 58, the subject matter of any one or more of Examples 56-57 optionally include wherein the plurality of materials are selected to provide at least one of a linearized frequency response, a reduced total harmonic distortion (THD), and an extended frequency response.

In Example 59, the subject matter of any one or more of Examples 56-58 optionally include wherein the plurality of materials are selected to provide at least one of an improved vocal recognition and an improved vocal clarity.

In Example 60, the subject matter of any one or more of Examples 47-59 optionally include wherein the piezoelectric microphone element, coupler strain relief, and coupler condenser are disposed within a microphone body housing.

In Example 61, the subject matter of Example 60 optionally includes wherein the microphone body housing is disposed within a head-worn accessory.

In Example 62, the subject matter of Example 61 optionally includes wherein the head-worn accessory includes a pair of eyeglasses.

In Example 63, the subject matter of any one or more of Examples 61-62 optionally include wherein the microphone body housing is disposed within an eyeglasses bridge, within an eyeglasses nose support, within an eyeglasses temple, or within an eyeglasses temple tip.

In Example 64, the subject matter of any one or more of Examples 61-63 optionally include wherein the head-worn accessory includes at least one of a hat, a sweatband, a protective helmet, a hearing assistance device, a Bluetooth headset, and an audio headphone.

In Example 65, the subject matter of any one or more of Examples 60-64 optionally include wherein the microphone body housing is disposed within a mobile electronic device.

In Example 66, the subject matter of Example 65 optionally includes wherein the mobile electronic device includes at least one of a cellular phone, a wristwatch, and a finger ring.

In Example 67, the subject matter of any one or more of Examples 47-66 optionally include the instructions further causing the computer-controlled device to generate a secondary electrical signal based on a secondary piezoelectric microphone element, a secondary coupler strain relief, and a secondary coupler condenser disposed in a second location, the secondary electrical signal to provide a spatially disparate signal processing feature.

In Example 68, the subject matter of Example 67 optionally includes wherein the spatially disparate signal processing feature includes at least one of noise cancellation, directional audible beamforming, and characterization of a head-related transfer function (HRTF).

Example 69 is a piezoelectric contact microphone apparatus comprising: means for receiving a vibration from a bony surface at an external contact surface; means for conveying the vibration from the external contact surface through a coupler condenser and a coupler strain relief to a piezoelectric microphone element; and means for transducing the vibration into an electrical signal at the piezoelectric microphone element.

In Example 70, the subject matter of Example 69 optionally includes wherein the coupler strain relief is configured to conduct vibrations from the coupler condenser to the piezoelectric microphone element while resisting a larger piezoelectric deformation.

In Example 71, the subject matter of Example 70 optionally includes wherein the coupler strain relief includes an initially pliable material cured during manufacturing to form the vibration-conductive condenser material.

In Example 72, the subject matter of any one or more of Examples 70-71 optionally include wherein the coupler strain relief includes a shear thickening material to conduct an instantaneous vibration signal and to allow for a low-frequency readjustment.

In Example 73, the subject matter of any one or more of Examples 71-72 optionally include wherein the coupler strain relief includes at least one flexible surface to accommodate movement of the shear thickening material.

In Example 74, the subject matter of any one or more of Examples 69-73 optionally include wherein the coupler condenser includes a vibration-conductive condenser material.

In Example 75, the subject matter of any one or more of Examples 69-74 optionally include wherein the coupler condenser includes a larger surface proximate to the external contact surface and a smaller surface proximate to the coupler strain relief, the combination of the larger surface and the smaller surface to increase a force per area unit on the coupler strain relief.

In Example 76, the subject matter of any one or more of Examples 69-75 optionally include wherein the external contact surface includes a vibration-conductive contact material.

In Example 77, the subject matter of any one or more of Examples 69-76 optionally include wherein the external contact surface includes a biocompatible layer to reduce skin irritation when placed on the bony surface.

In Example 78, the subject matter of any one or more of Examples 69-77 optionally include wherein a plurality of materials within the piezoelectric microphone element, coupler strain relief, coupler condenser, and external contact surface are selected to produce a voice signal that minimizes digital signal processing.

In Example 79, the subject matter of any one or more of Examples 69-78 optionally include wherein a plurality of materials within the piezoelectric microphone element, coupler strain relief, coupler condenser, and external contact surface are selected to produce a voice signal that does not require digital signal processing.

In Example 80, the subject matter of any one or more of Examples 78-79 optionally include wherein the plurality of materials are selected to provide at least one of a linearized frequency response, a reduced total harmonic distortion (THD), and an extended frequency response.

In Example 81, the subject matter of any one or more of Examples 78-80 optionally include wherein the plurality of materials are selected to provide at least one of an improved vocal recognition and an improved vocal clarity.

In Example 82, the subject matter of any one or more of Examples 69-81 optionally include wherein the piezoelectric microphone element, coupler strain relief, and coupler condenser are disposed within a microphone body housing.

In Example 83, the subject matter of Example 82 optionally includes wherein the microphone body housing is disposed within a head-worn accessory.

In Example 84, the subject matter of Example 83 optionally includes wherein the head-worn accessory includes a pair of eyeglasses.

In Example 85, the subject matter of any one or more of Examples 83-84 optionally include wherein the microphone body housing is disposed within an eyeglasses bridge, within an eyeglasses nose support, within an eyeglasses temple, or within an eyeglasses temple tip.

In Example 86, the subject matter of any one or more of Examples 83-85 optionally include wherein the head-worn accessory includes at least one of a hat, a sweatband, a protective helmet, a hearing assistance device, a Bluetooth headset, and an audio headphone.

In Example 87, the subject matter of any one or more of Examples 82-86 optionally include wherein the microphone body housing is disposed within a mobile electronic device.

In Example 88, the subject matter of Example 87 optionally includes wherein the mobile electronic device includes at least one of a cellular phone, a wristwatch, and a finger ring.

In Example 89, the subject matter of any one or more of Examples 69-88 optionally include means for generating a secondary electrical signal based on a secondary piezoelectric microphone element, a secondary coupler strain relief, and a secondary coupler condenser disposed in a second location, the secondary electrical signal to provide a spatially disparate signal processing feature.

In Example 90, the subject matter of Example 89 optionally includes wherein the spatially disparate signal processing feature includes at least one of noise cancellation, directional audible beamforming, and characterization of a head-related transfer function (HRTF).

Example 91 is at least one machine-readable medium including instructions, which when executed by a machine, cause the machine to perform operations of any of the operations of Examples 1-90.

Example 92 is an apparatus comprising means for performing any of the operations of Examples 1-90.

Example 93 is a system to perform the operations of any of the Examples 1-90.

Example 94 is a method to perform the operations of any of the Examples 1-90.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of"at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to allow the reader to quickly ascertain the nature of the technical disclosure. It is submitted with the understanding that it will not be used to interpret or limit the scope or meaning of the claims. In the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope should be determined with reference to the appended claims, along with the full scope of equivalents to which such claims are entitled.

The invention claimed is:

1. A piezoelectric contact microphone system comprising:

a piezoelectric microphone element;

a coupler strain relief disposed on the piezoelectric microphone element;

a coupler condenser disposed on the coupler strain relief, the coupler strain relief configured to conduct vibrations from the coupler condenser to the piezoelectric microphone element while resisting a larger piezoelectric deformation, the coupler strain relief including an initially pliable material cured during manufacturing to form the vibration-conductive condenser material; and an external contact surface disposed between the coupler condenser and a bony surface to conduct vibrations from the bony surface through the coupler condenser and coupler strain relief to the piezoelectric microphone element.

2. The system of claim 1, the coupler strain relief including a shear thickening material to conduct an instantaneous vibration signal and to allow for a low-frequency readjustment.

3. The system of claim 1, the coupler strain relief including at least one flexible surface to accommodate movement of the shear thickening material.

4. The system of claim 1, the coupler condenser including a larger surface proximate to the external contact surface and a smaller surface proximate to the coupler strain relief, the combination of the larger surface and the smaller surface to increase a force per area unit on the coupler strain relief.

5. The system of claim 1, wherein a plurality of materials within the piezoelectric microphone element, coupler strain relief, coupler condenser, and external contact surface are selected to produce a voice signal that minimizes digital signal processing.

6. The system of claim 1, wherein the piezoelectric microphone element, coupler strain relief, and coupler condenser are disposed within a microphone body housing.

7. The system of claim 6, wherein the microphone body housing is disposed within a head-worn accessory.

8. The system of claim 7, wherein the head-worn accessory includes a pair of eyeglasses.

9. The system of claim 7, wherein the microphone body housing is disposed within an eyeglasses bridge, within an eyeglasses nose support, within an eyeglasses temple, or within an eyeglasses temple tip.

10. The system of claim 1, further including a secondary piezoelectric microphone element, a secondary coupler strain relief, and a secondary coupler condenser disposed in a second location to provide a spatially disparate signal processing feature.

11. A method for implementing a piezoelectric contact microphone comprising:

receiving a vibration from a bony surface at an external contact surface;

conveying the vibration from the external contact surface through a coupler condenser and a coupler strain relief to a piezoelectric microphone element, the coupler strain relief configured to conduct vibrations from the coupler condenser to the piezoelectric microphone element while resisting a larger piezoelectric deformation, the coupler strain relief including an initially pliable material cured during manufacturing to form the vibration-conductive condenser material; and transducing the vibration into an electrical signal at the piezoelectric microphone element.

12. The method of claim 11, wherein the coupler strain relief includes a shear thickening material to conduct an instantaneous vibration signal and to allow for a low-frequency readjustment.

13. The method of claim 11, wherein a plurality of materials within the piezoelectric microphone element, coupler strain relief, coupler condenser, and external contact surface are selected to produce a voice signal that minimizes digital signal processing.

14. The method of claim 13, wherein the plurality of materials are selected to provide at least one of a linearized frequency response, a reduced total harmonic distortion (THD), and an extended frequency response.

15. The method of claim 13, wherein the plurality of materials are selected to provide at least one of an improved vocal recognition and an improved vocal clarity.

16. The method of claim 11, wherein a plurality of materials within the piezoelectric microphone element, coupler strain relief, coupler condenser, and external contact surface are selected to produce a voice signal that does not require digital signal processing.

17. The method of claim 11, further including generating a secondary electrical signal based on a secondary piezoelectric microphone element, a secondary coupler strain relief, and a secondary coupler condenser disposed in a second location, the secondary electrical signal to provide a spatially disparate signal processing feature.

18. The method of claim 17, wherein the spatially disparate signal processing feature includes at least one of noise cancellation, directional audible beamforming, and characterization of a head-related transfer function (HRTF).

19. At least one non-transitory machine-readable storage medium, comprising a plurality of instructions that, responsive to being executed with processor circuitry of a computer-controlled device, cause the computer-controlled device to:

receive a vibration from a bony surface at an external contact surface;

convey the vibration from the external contact surface through a coupler condenser and a coupler strain relief to a piezoelectric microphone element, the coupler strain relief configured to conduct vibrations from the coupler condenser to the piezoelectric microphone element while resisting a larger piezoelectric deformation, the coupler strain relief including an initially pliable material cured during manufacturing to form the vibration-conductive condenser material; and transduce the vibration into an electrical signal at the piezoelectric microphone element.

20. The non-transitory machine-readable storage medium of claim 19, wherein the coupler condenser includes a larger surface proximate to the external contact surface and a smaller surface proximate to the coupler strain relief, the combination of the larger surface and the smaller surface to increase a force per area unit on the coupler strain relief.

* * * * *